United States Patent [19]

Frisbee

[11] 4,185,698

[45] Jan. 29, 1980

[54] ADJUSTABLE AUGER DOZER

[75] Inventor: Claude M. Frisbee, Bettendorf, Iowa

[73] Assignee: J. I. Case Company, Racine, Wis.

[21] Appl. No.: 881,294

[22] Filed: Feb. 27, 1978

[51] Int. Cl.[2] ..... E02F 3/06; E02F 3/76; A01B 35/18

[52] U.S. Cl. ..... 172/71; 172/785; 172/801; 37/108 R

[58] Field of Search ..... 172/71, 30, 785, 801, 172/784; 37/142.5, 43 D, 108 R, 43 F

[56] References Cited

U.S. PATENT DOCUMENTS

| | | | |
|---|---|---|---|
| 2,109,393 | 2/1938 | Le Bleu | 172/801 X |
| 2,132,790 | 10/1938 | Jeswine | 37/43 F |
| 2,626,470 | 1/1953 | Cook et al. | 172/801 |
| 3,091,873 | 6/1963 | West | 37/108 R X |
| 3,693,722 | 9/1972 | Brown | 37/108 X |
| 3,722,114 | 3/1973 | Knell et al. | 37/430 X |
| 3,735,818 | 5/1973 | Swisher et al. | 172/785 |

*Primary Examiner*—Paul E. Shapiro
*Attorney, Agent, or Firm*—Cullen, Sloman, Cantor, Grauer, Scott & Rutherford

[57] ABSTRACT

An earth working dozer or tractor having a transverse blade and an adjustable spiral auger supported forward of the blade which further crushes material lifted by the blade and moves the material transverse of the blade. The blade includes opposed support-drive links which are pivotally supported at one end on top of the blade and which extend forwardly to receive the auger. The links are connected by a bar, spaced from the pivotal support, which is connected to the dozer frame by one or more hydraulic piston-cylinders. The position of the auger relative to the blade may thus be adjusted in parallel relation by extending or retracting the piston-cylinders, swinging the spiral auger about the pivot axes of the support links.

8 Claims, 3 Drawing Figures

FIG. 1
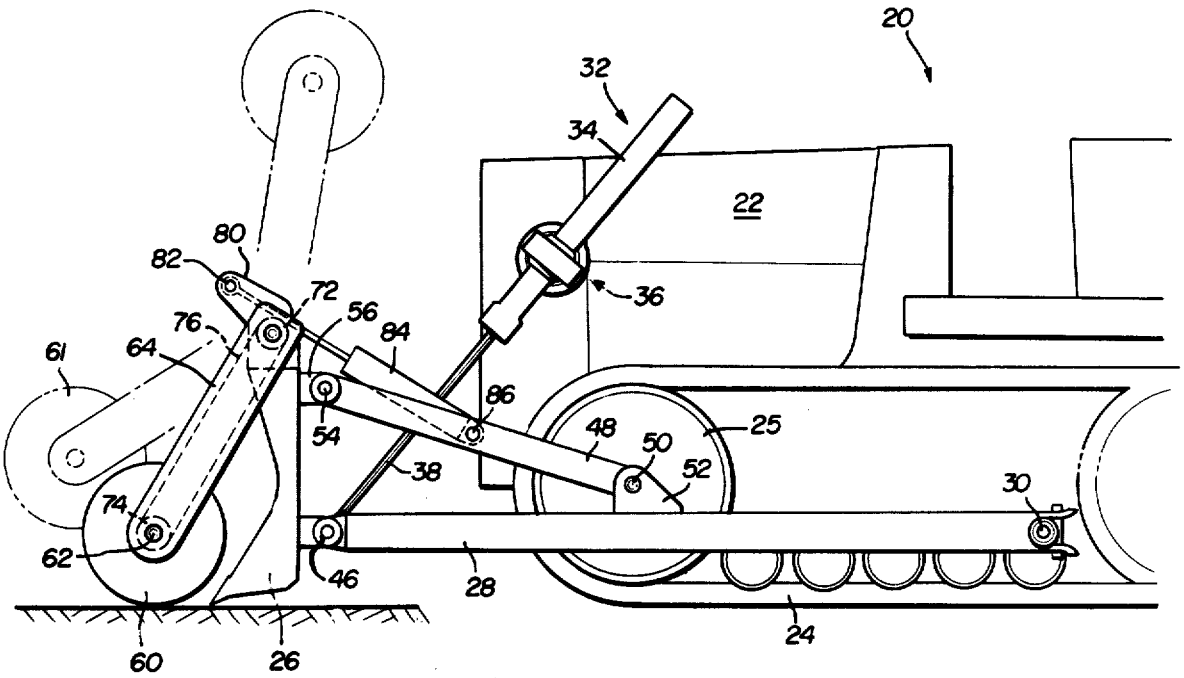
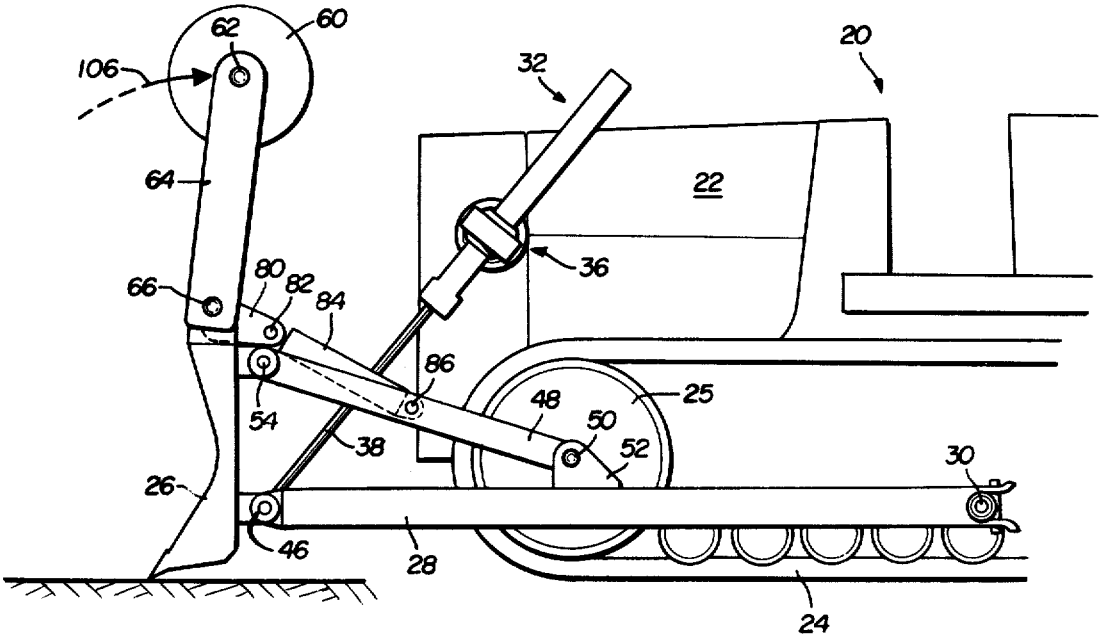
FIG. 2

ADJUSTABLE AUGER DOZER

FIELD OF THE INVENTION

This invention relates to earth working machines such as bulldozers or the like having a transverse blade and a power driven revolvable spiral auger for moving the earth or other material dozed by the blade transverse of the blade.

Description of the Prior Art

Sprial auger dozers of the type disclosed herein have been suggested by the prior art, including auger assemblies supported on the dozer blade, such as shown in U.S. Pat. Nos. 3,091,873, 3,362,092, and 3,503,450. The auger dozer is particularly useful in backfilling or other dozer operations where the earth or other material is dozed by the dozer or tractor and preferably deposited on one or the other side of the blade. This operation may also be accomplished by angling the blade about its center vertical axis, such that the material dozed is deposited off the trailing blade edge. Power angle dozers such as disclosed in my U.S. Pat. No. 3,606,929 are however relatively expensive and manual angle dozers are generally difficult to angle. Further, the blade of an angle dozer must be relatively wide, requiring a special permit to transport. An auger dozer thus provides many of the advantages of an angle dozer and may be used in combination with a rigidly mounted bulldozer blade for backfilling and other applications.

There are three principle disadvantages of the auger dozers disclosed in the prior art. In the prior art, the blade and dozer must generally be modified or a special blade assembly is used to support and power the auger. Second, once the auger is assembled to the blade, the dozer cannot be used for other dozer applications. Finally the auger dozers disclosed in the prior art have not been successful in cutting hard material, such as packed clay, etc. The auger dozer of the present invention may be assembled on any conventional bulldozer blade, including straight dozers, power assisted tilt and angle dozers, etc. providing additional advantages for the auger dozer of this invention. Second, the auger may be hydraulically moved out of its operating position in the auger dozer of the present invention, permitting use of the blade for conventional dozer applications. Finally, the auger may be adjusted relative to the blade to cut hard material dozed by the blade, increasing the applications of the auger dozer of this invention.

SUMMARY OF THE INVENTION

As described above, the adjustable auger dozer of this invention may include a conventional bulldozer, tractor or the like having a transverse blade, such as a straight dozer or a power tilt bulldozer or other earth working implement having a transverse blade. The assembly which includes a sprial auger supported by the blade generally parallel to and forward of the blade which moves the material lifted by the blade laterally of the blade. In the preferred embodiment of the auger dozer of this invention, the auger is adjustable relative to the blade for different applications. For example, the auger may be lowered to ground level and operated, such that the auger casts the earth to the side of the blade, similar to an angle dozer or motor grader. The auger can also be swung up and out of the way of the dozer blade by the power adjust mechanism such that the bulldozer or tractor can be used for conventional dozing applications. Finally, the auger can be raised slightly such that the dozer cutting edge can cut and break hard material, such as clay and lift the material into the auger where it is cut and cast to the side. Thus, the adjustable auger dozer of the present invention has several advantages over the prior art as disclosed more fully herein below.

In the preferred embodiment of the auger dozer of this invention, the blade includes a pair of support arms or links pivotally connected adjacent the top of the blade and extending forwardly to receive the spiral auger in journaled relation and an extensible power means is connected between the support arms or links and the prime mover for adjusting the position of the spiral auger relative to the blade in parallel or near parallel relation. The auger may thus be lowered to ground level for backfilling, raised so the dozer blade can cut and break hard material or raised out of the way for normal dozing operations.

In the disclosed embodiment of the invention, the dozer includes a transverse blade which is supported by push beams and the like. The extensible power means comprises one or a pair of fluid operated piston-cylinders, one connected on each side of the blade to the adjacent support arm or link. In the disclosed embodiment, the support links are interconnected by a rod or bar and the piston-cylinders are connected to the bar for rotating the support arms about their pivotable support to adjust the position of the spiral auger. In the disclosed embodiment, the blade is also supported by structural members or struts interconnected between the push-beams and the upper side edges of the blade.

As described, the auger assembly may be easily attached to any conventional tractor or bulldozer blade. The drive for the spiral auger is preferrably a variable speed reversable hydraulic motor which may be mounted on the top of the bulldozer blade. Similarly, the support arms or links may be supported on top of the blade by pivot rods welded or otherwise secured to the top of the blade. The hydraulic control for the auger swing cylinder or cylinders and the hydraulic motor may be connected to the hydraulic system of the bulldozer control or a separate hydraulic system. The auger may also be driven by electric motors or other controls may be utilized. The auger may then be adjusted relative to the dozer blade in generally parallel relation as described above for use in combination with the dozer blade or separately. Other advantages and meritorious features of the auger dozer of this invention will be more fully understood from the following description of the preferred embodiments, the appended claims and the drawings, a brief description of which follows.

BRIEF DESCRIPTION OF THE DRAWINGS

FIG. 1 is a partial side view of a conventional bulldozer having the auger dozer of the present invention;

FIG. 2 is a side view, similar to FIG. 1, with the spiral auger raised to its upper most position out of the way of the dozer blade.

DESCRIPTION OF THE PREFERRED EMBODIMENTS

Figure 3:
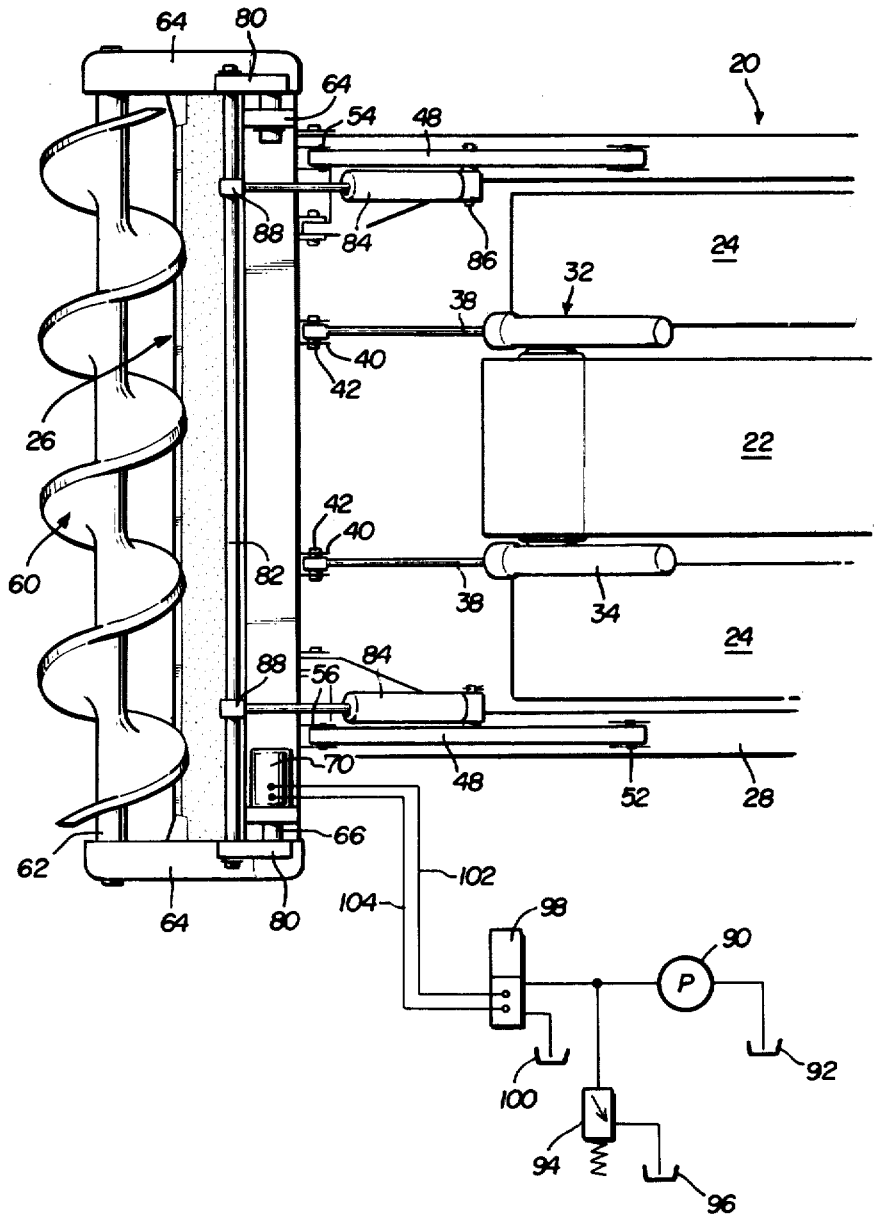
FIG. 3 is a partial top view of the auger dozer shown in FIGS. 1 and 2 with the auger in the position of FIG. 1.

As described, the adjustable auger dozer of this invention may be used in combination with any conventional vehicle, including bulldozers, tractors and the like. The disclosed embodiment of the auger dozer is shown in combination with a conventional bulldozer 20 having a motor 22 which rotatably drives crawler sprockets 25 and continuous tracks 24. The transverse bulldozer blade 26 is mounted by push-beams 28. In the disclosed embodiment, the rearward ends of the push-beams are supported on the bulldozer by pivotal connections 30 and lift cylinders 32 are connected between the blade and the bulldozer.

In the disclosed embodiment, there are two lift cylinders each having a cylinder portion 34 universaly supported on one side of the bulldozer by a trunnion mounting 36. The rod portion 38 of each lift cylinder is pivotally connected to a bracket 40 on the blade by pivot pins 42. The brackets 40 are welded or otherwise secured on opposed sides of the blade as best shown in FIG. 3. The blade 26 may thus be raised or lowered by extending or retracting cylinders 32. Further, as described below, the blade may be slightly tilted about the longitudinal axis of the vehicle by extending one lift cylinder 32 and retracting the opposed cylinder.

The sides of the bulldozer blade 26 are supported on the push-beams 28 in the disclosed embodiment by sruts or structural support members 48. The rearward end of the struts 48 are connected by universal connections 50 to bracket 52 on the push-beams 28 and the forward end of the struts are connected by universal connections 54 to brackets 56 on the rear of the dozer blade. Where the blade is simply raised or lowered, the universal connections 50 and 54 may be simply pivot pins, however where the blade is to be tilted, the connections 50 and 54 are ball-type connections having a center rod permitting universal movement of the connections as will be understood by those skilled in the art. The brackets 52 and 56 may be welded or otherwise secured to the steel push-beams and bulldozer blade, respectively.

The auger 60 in the disclosed embodiment is a conventional spiral or helical worm auger having a supporting shaft 62 rotatably supported by arms or links 64. The journal bearings in the arms 64 for the auger shaft may be conventional and are not shown in detail. The opposed ends of the support arms 64 are pivotally supported on pivot shafts or rods 66 which are supported in blocks 68 welded or otherwise secured to the top of the bulldozer blade 26 as best shown in FIG. 3. The bulldozer blade 26 may be of conventional rigid box construction having a top steel plate to which block 68 may be attached.

In the preferred embodiment, the auger assembly is self contained. In the disclosed embodiment, the spiral auger 60 is rotatably driven by a variable hydraulic motor 70 which is also mounted on the top of the blade as shown in FIG. 3. The hydraulic motor includes a drive sprocket 72 shown in phantom in FIG. 1, a driven sprocket 74 connected to the shaft 62 of the spiral auger and a drive chain 76. A suitable hydraulic circuit for the motor 70 is shown in FIG. 3 and include a variable hydraulic pump 90 and reservoir 92, a spring release valve 94 and reservoir 96 and control valve 98 and reservoir 100. Thus, the control valve 98 may be operated to rotate the spiral auger at variable speeds in forward or in reverse and the relief valve 94 will prevent overload of the circuit. As would be understood by those skilled in the art, the hydraulic circuit may be connected to the hydraulic control of the bulldozer and the control valve 98 may be set in the control compartment of the bulldozer.

The adjustment mechanism for the auger 60 in the disclosed embodiment includes a pair of swing links 80 which are rigidly connected and extend generally perpendicular to the support links or arms 64 as shown in FIGS. 1 and 2. The swing links 80 are interconnected by transverse swing rod 82. The swing links 80 and rod 82 are rotated about the axis of pivot shaft 66 by swing cylinders 84 as follows. The swing cylinders are pivotally connected at 86 to the mid portion of struts 48 and the rod protions are connected by bearings 88 to swing rod 82. Thus, as shown in FIGS. 1 and 2, the auger 60 may be lowered by extending swing cylinders 84, rotating swing links 80 in a clockwise direction. The auger is raised by retracting swing cylinders 84, rotating swing rod 82 and swing links 80 in a clockwise direction as shown by arrow 106 in FIG. 2. Thus, the position of the auger 60 may be adjusted relative to the blade in parallel relation by extending or retracting swing cylinders 84. As will be understood by those skilled in the art, cylinders 84 are preferably hydraulic cylinders connected by a conventional parallel hydraulic circuit.

As best shown in FIGS. 1 and 2, the position of the auger may be adjusted for different operations of the auger dozer. For example, the auger 60 may be swung out of the way as shown in FIG. 2 for conventional dozer operations. Alternatively, the dozer may be lowered to the position shown in FIG. 1 by fully extending the swing cylinders 84 and the auger rotated by hydraulic motor 70 to move material laterally in either direction. The bulldozer may thus be operated as a conventional angle dozer or motor grader. The auger may also be partially raised as shown in phantom at 61 in FIG. 1 to cut and move relatively hard material, such as clay or similar materials. In the position of 61, the blade will cut and break hard dirt or other materials and lift the dirt into the rotating auger 61. The auger will then cut and crush the hard material and move the material laterally off of the blade as described above. In the disclosed embodiment, the auger may be adjusted to any preferred position depending upon the condition of the material or the auger may be adjusted out of the way of the blade as described above.

It will be understood that various details of the prime mover and auger dozer assembly have not been described because such details will be known to those skilled in the art. For example, the various structural elements, including the support arms 64, the struts 48, etc. may be formed of sheet steel and welded or otherwise secured. Further, various modifications may be made to the disclosed structure without departing from the purview of the appended claims.

I claim:

1. An earth working machine having, in combination, a prime mover, an earth working blade supported generally transverse to the longitudinal axis of said machine and a spiral auger supported by said blade generally parallel to and forward of said blade to move the material laterally of said blade, said auger journaled between drive links, said drive links, each pivotally supported adjacent one end on opposed sides of said blade and said drive links interconnected by a rod above and parallel to said blade, said auger rotatably journaled between said links adjacent the opposed link ends, and extensible piston-cylinders connected between said rod and said prime mover on opposed sides of said blade for adjusting the position of said spiral auger relative to said blade by rotating said drive links, thereby raising and lowering said auger in parallel relation to said blade.

2. The earth working machine defined in claim 1, characterized in that said prime mover includes push-beams on opposed sides of said earth working machine, said transverse blade supported on said push-beams and a pair of structural support members interconnected between said push-beams and the upper side portions of said blade, and said extensible piston-cylinders each connected between one of said structural support members and said rod on one of the opposed sides of said blade for rotatably adjusting said drive links and said spiral auger relative to the blade.

3. The earth working machine defined in claim 2, characterized in that said drive links are pivotally supported on the top of said blade and said auger is driven by a variable speed motor mounted on the top of said blade.

4. An earth working machine, comprising a prime mover, a push-beam pivotally supported on opposed sides of said machine, an earth working blade supported on the ends of said push-beams, generally perpendicular to the longitudinal axis of said prime mover, said blade having a pair of support links pivotally connected to the upper portion of said blade on opposed sides of said blade and said links extending forwardly, a spiral auger journaled between said support links and rotatably driven by a drive means, said opposed support links interconnected by a transverse rod generally parallel to said blade and extensible fluid piston cylinders connected between said frame and said transverse rod for adjusting the position of said auger relative to said blade in generally parallel relation.

5. The earth working machine defined in claim 4, characterized in that the support for said blade includes structural support members pivotally connected at one end to one of said push-beams, one on each side of said blade and the opposed end of each structural member being connected to one side of said blade and each of said hydraulic pistons being pivotally connected to one of said structural support members.

6. The earth working machine defined in claim 4, characterized in that said support links are pivotally supported on pivot rods generally parallel to said blade and mounted on top of said blade, each support link including a rigidly connected transverse swing link and said transverse rod being connected between said swing links.

7. The earth working machine defined in claim 4, characterized in that said drive means includes a variable speed motor mounted on top of said blade driveably connected to said spiral auger by a chain drive within one of said support links.

8. The earth working machine defined in claim 4, characterized in that each of said push-beams is pivotally connected adjacent its end to said earth working machine and the position of the auger-blade assembly being adjustable by fluid pistons connected between said prime mover and said push-beams.

* * * * *